US006493977B1

(12) United States Patent
Liebenberg et al.

(10) Patent No.: US 6,493,977 B1
(45) Date of Patent: Dec. 17, 2002

(54) FIREARM HAVING CHAMBER STATUS INDICATOR AND FIREARM RETROFITTING METHOD

(75) Inventors: Paul Liebenberg, Agawam, MA (US); James M. Quill, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/653,431

(22) Filed: Sep. 1, 2000

Related U.S. Application Data

(63) Continuation-in-part of application No. 09/079,676, filed on May 15, 1998, now Pat. No. 6,161,322.

(51) Int. Cl.[7] ..... F41A 21/00
(52) U.S. Cl. ..... 42/1.05
(58) Field of Search ..... 42/1.01, 1.05

(56) References Cited

U.S. PATENT DOCUMENTS

| | | | | |
|---|---|---|---|---|
| 808,463 A | * | 12/1905 | Luger | 42/1.05 |
| 945,328 A | | 1/1910 | Johnson | |
| 1,028,032 A | | 5/1912 | Krag | |
| 2,416,712 A | | 3/1947 | Parker | |
| 3,229,399 A | * | 1/1966 | Harvey | 42/1.05 |
| 3,401,665 A | | 9/1968 | Kelley | |
| 3,901,125 A | | 8/1975 | Raville | |
| 4,089,250 A | | 5/1978 | Jakubowski, Jr. et al. | |
| 4,103,639 A | * | 8/1978 | Otteson | 42/1.05 |
| 4,216,601 A | | 8/1980 | Musgrave | |

FOREIGN PATENT DOCUMENTS

| | | |
|---|---|---|
| DE | 334041 | 3/1921 |
| FR | 395045 | 2/1909 |

* cited by examiner

*Primary Examiner*—Stephen M. Johnson
(74) *Attorney, Agent, or Firm*—McCormick, Paulding & Huber LLP

(57) ABSTRACT

A semi-automatic breech locking pistol has a reciprocally movable slide which includes an integral bolt and defines an upwardly and laterally outwardly open ejection port forward of the bolt. A barrel at least partially disposed within the slide has a chamber and a rearwardly extending headspace extension hood and provides a closure for the ejection port in locked breech condition. A chamber status indicator formed by a rearwardly open notch in the headspace extension hood facilitates determination of chamber status by direct visual observation and may also include a forwardly open groove in the bolt which cooperates with the notch in locked breech condition.

21 Claims, 3 Drawing Sheets

FIREARM HAVING CHAMBER STATUS INDICATOR AND FIREARM RETROFITTING METHOD

CROSS REFERENCE TO RELATED APPLICATION

This is a continuation-in-part of application Ser. No. 09/079,676 filed May 15, 1998 now U.S. Pat. No. 6,161,322.

FIELD OF INVENTION

This invention relates in general to firearms and chamber status indicators for firearms generally and deals more particularly with an improved chamber status indicator for a semi-automatic or auto-loading handgun, which has a barrel including a headspace extension hood, and a method for retrofitting such a handgun with a chamber status indicator.

BACKGROUND OF THE INVENTION

The present invention is concerned with improvements in firearms and particularly semi-automatic or auto-loading pistols of the type having reciprocal breech closures. Such pistols, of conventional construction, fire in response to trigger pressure and automatically re-load and return to closed breech position ready to fire again. The user of such an auto-loading pistol cannot determine with certainty whether there is a round in the barrel chamber after the pistol has been fired, because the breech is in its closed position.

Heretofore various mechanical devices have been provided on such auto-loading pistols to indicate the presence of a round in the chamber. Such mechanical devices typically employ intricate mechanisms and often include some form of mechanical sensor for engaging a portion of a chambered cartridge and altering the position of an associated externally exposed indicator, thereby signaling the presence of a cartridge in the barrel chamber. However, the provision of such a mechanical device on a firearm usually add substantially to the cost of producing the gun. Further, if a mechanical chamber status indicating device becomes damaged it may falsely indicate a safe or unloaded chamber condition, which could lead to a disastrous result. Those devices which provide chamber status indication by the change of position of an indicator may require the gun user to rapidly recall the indicator position associated with a particular chamber condition, which introduces the possibility of human error.

A further approach to the problem has been to provide a sighting opening in the barrel which opens into the bore immediately forward of the cartridge chamber or into the cartridge chamber to allow direct viewing of a portion of a chambered cartridge. However, as far as can be determined, previous efforts to provide a satisfactory observation port in the barrel of a firearm have been unsuccessful. Another somewhat similar approach has been to provide a peep-notch at least partially defined by the bolt and opening through the bolt face to permit direct observation of a portion of the rim or base of a chambered cartridge. However, of the aforesaid approaches are invasive to critical parts of the firearm and tend to compromise the structural integrity of either or both the barrel and the bolt, which may cause cartridge jamming or improper cartridge extraction.

Accordingly, it is the general aim of the present invention to provide, in a semi-automatic or auto-loading handgun having a reciprocally movable breech closure and which includes an improved chamber status indicator which allows direct visual inspection of a portion of the breech when the breech closure is in its closed position. A further aim of the present invention is to provide a breech observation aperture in a firearm of the aforedescribed type without compromising the structural integrity of the firearm or significantly increasing the cost of producing it. Yet another aim of the invention is to provide a method for retrofitting a firearm of the aforedescribed general type to provide the firearm with a breech observation aperture without jeopardizing the structural integrity of the firearm.

SUMMARY OF THE INVENTION

In accordance with the present invention, an improved auto-loading pistol has a frame and a slide which includes a forwardly facing bolt face and an upwardly and laterally outwardly open ejection port. The slide is supported on the frame for forward and rearward reciprocal movement between firing and retracted positions respectively corresponding to closed and open breech conditions. The pistol further includes a barrel having a rearwardly facing breechface, a bore defined by and extending through the barrel, a chamber at the rear of the bore and opening through the breechface, and a headspace extension hood projecting rearwardly from the breechface above the chamber. In the closed breech condition the headspace extension hood overlies headspace formed between the breechface and the bolt face. In accordance with the present invention, a chamber status indicating means is provided for enabling a user of the gun to determine whether a round of ammunition is chambered within the gun and comprises a rearwardly open first notch formed in the headspace extension hood and a forwardly open second notch formed in the slide. The first notch is exposed within the ejection port when the slide is in a closed breech or firing position and cooperates with the second notch to permit a user of the pistol to determine chamber status by direct observation while pointing the pistol down range.

DETAILED DESCRIPTION OF PREFERRED EMBODIMENT AND METHOD

Figure 1:
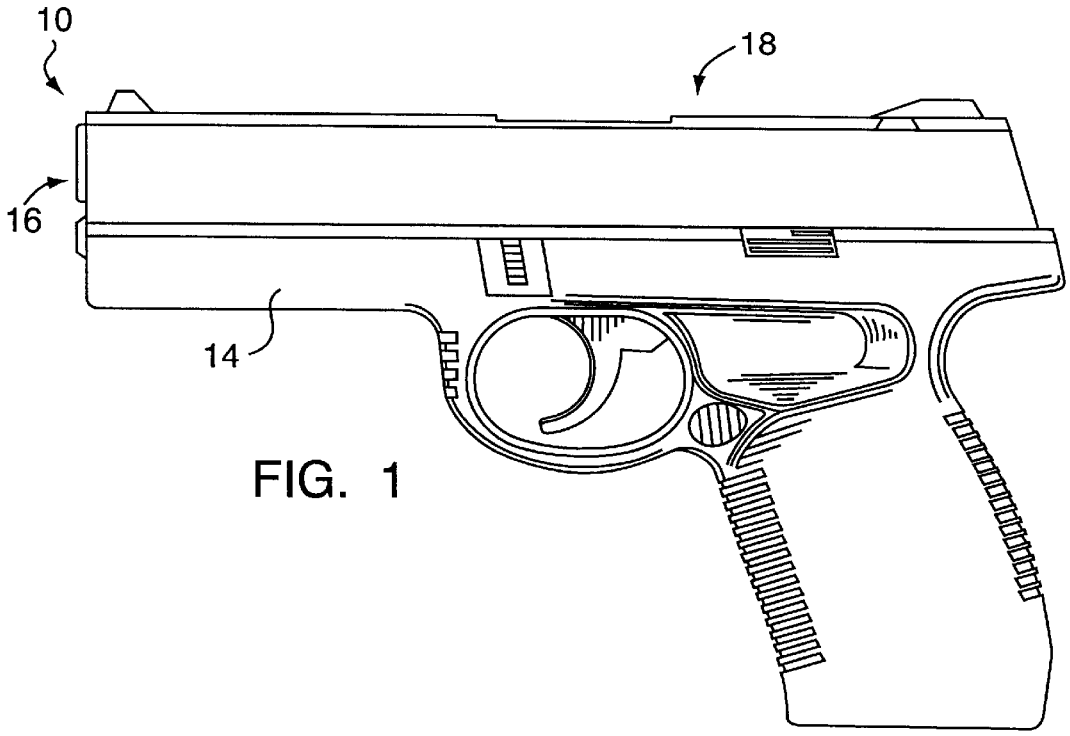
FIG. 1 is a left side elevational view of a semi-automatic or autoloading pistol embodying the present invention.

Although the chamber status indicator of the present invention may be utilized in virtually any firearm having a barrel including an externally exposed headspace extension hood, it is particularly suitable for use in a semi-automatic or auto-loading handgun of a type which has a reciprocally movable breech closure or slide and employs either a locking breech or blowback system of operation.

In the drawing and in the description which follows, the invention is illustrated and described with reference to a semi-automatic handgun or pistol of the locked breech type. In a pistol of the latter type the breech closure or bolt, which usually comprises an integral part of the slide, is securely locked to the barrel and remains in a locked condition until the bullet has left the barrel and the pressure at the breech, generated by the gasses of explosion, has dropped to a level at which it is safe to open the breech and commence cartridge extraction, all of which is well known in the firearm art.

The chamber status indicator of the present invention is illustrated and hereinafter further described with reference to a SMITH & WESSON SIGMA SERIES Model SW40V semi-automatic pistol, shown in FIG. 1 and indicated generally by the reference numeral 10, modified to include a chamber status indicator designated generally by the reference numeral 12. The illustrated pistol 10 is manufactured and marketed by Smith & Wesson, Springfield, Mass. 01102, assignee of the present invention.

Figure 2:
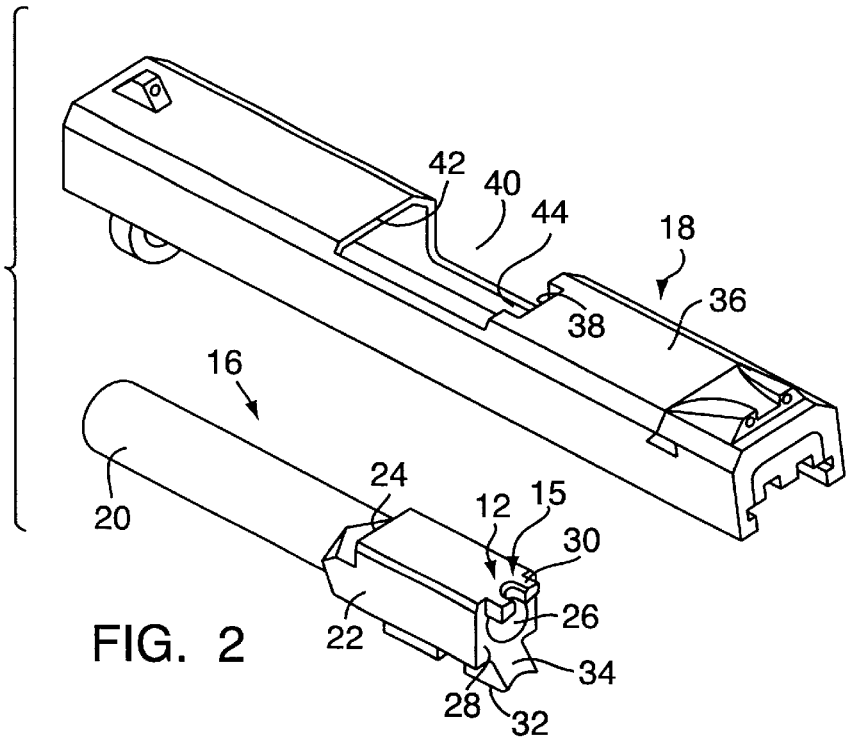
FIG. 2 is a an exploded perspective view showing the slide and the barrel of the pistol of FIG. 1.
Figure 3:
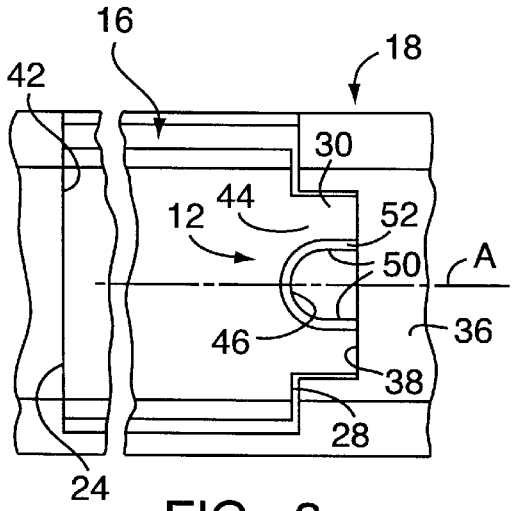
FIG. 3 is a somewhat enlarged fragmentary top plan view showing the barrel and slide in closed breech position.
Figure 4:
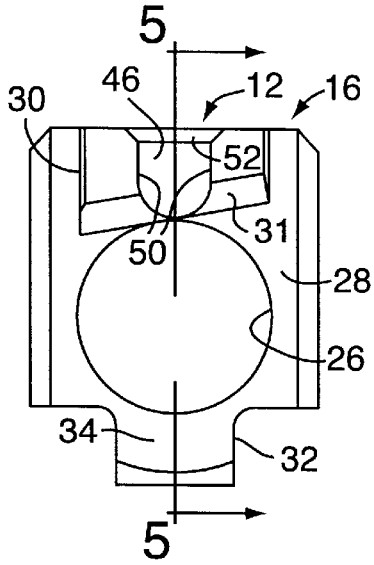
FIG. 4 is a somewhat enlarged rear elevational view of the barrel.
Figure 5:
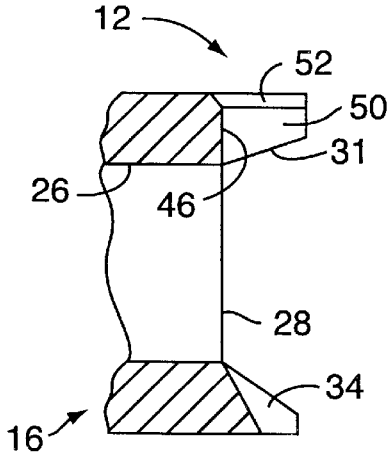
FIG. 5 is a fragmentary sectional view through the barrel taken along the line 5—5 of FIG. 4.

In the drawing and in the further description which follows, only those components of the firearm 10 essential to an understanding of the chamber status indicator 12 are illustrated and described in detail. Further referring to the drawing, the illustrated pistol 10 has a frame 14, a barrel loosely attached to the frame and indicated generally by the reference numeral 16 and a partially hollow slide designated generally by the numeral 18 within which at least a portion of the barrel 16 is contained. The slide is supported on the frame 14 by conventional ways for rearward and forward reciprocal sliding movement relative to the frame between firing and retracted positions corresponding, respectively, to closed and open breech positions. In FIG. 1 the pistol 10 is shown in its closed breech or firing position. The axially elongated barrel 16, best shown in FIG. 2, defines a conventional axially extending pistol bore and has a generally cylindrical forward end portion 20 and a somewhat radially enlarged rear portion 22 of generally rectangular cross-section. The rear portion has a forwardly facing upper edge 24 and defines a chamber 26 at the rear end of the bore which opens through a rearwardly facing breechface 28. A headspace extension hood 30, which comprises an integral part of the barrel 16, projects rearwardly from the breechface 28 immediately above the chamber 26 as best shown in FIGS. 2–4. The headspace extension hood has a generally rectangular configuration, as viewed from above, and as best shown in FIG. 3, and has an upwardly and laterally inclined lower surface 31. The lower surface 31 is also rearwardly and upwardly inclined from the breechface. A conventional integral barrel cam 32 depends from the rear part 22 and defines a downwardly and rearwardly inclined and rearwardly facing ramp surface 34 which cooperates with a cartridge magazine (not shown) to guide a cartridge into the chamber 26 in response to return movement of the slide 18 to its closed breech position after the pistol 10 has been fired, all of which is conventional and well-known in the pistol art.

The pistol slide 18 has a hollow downwardly open forward portion for receiving at least a part of the barrel 16. The rear end portion of the slide defines and integral bolt 36 having a forwardly facing bolt face 38, shown in FIG. 6. An ejection port 40 opens upwardly and laterally outwardly through the right side of the slide, as shown in FIG. 2. The forward end of the ejection port 40 is defined by a rearwardly facing edge surface 42. The ejection port 40 has a forwardly open notch 44 for receiving and generally complementing the headspace extension hood 30 when the pistol 10 is in its closed breech or firing position, as it appears in FIG. 3. The forwardly facing rear surface of the notch 44 lies within the plane of the bolt face 38 and is defined by an upward extension of the bolt face 38.

Figure 6:
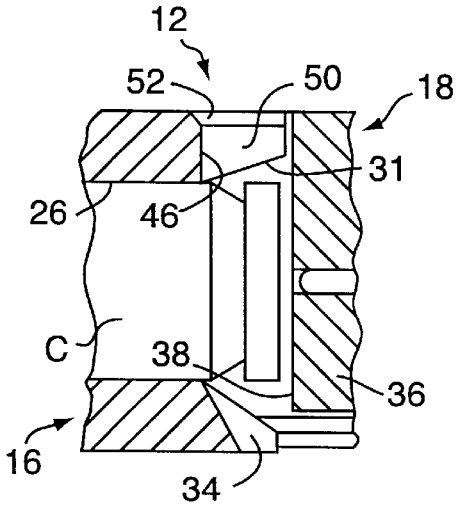
FIG. 6 is a fragmentary axial sectional view through the barrel and the slide and shows the breech in closed position and a round of ammunition in the chamber.

When the pistol 10 is in its closed breech position, as it appears in FIGS. 1, 3 and 6, the headspace extension hood 30 is disposed within the notch 44 and overlies the headspace, that is the space between the breechface and the bolt face taken up by that portion of a cartridge which includes the extractor groove and the cartridge rim. When the breech is closed the forwardly facing surface 24 on the barrel is engaged with the rearwardly facing surface 42 on the slide thereby locking the barrel to the slide. The pistol 10 normally returns to the latter breech locked position after each round has been fired.

In accordance with the present invention, the chamber status indicator 12 essentially comprises the aperture or notch indicated generally by the numeral 15 and which is formed in the headspace extension hood 30. Preferably, and as shown, the notch 15 extends in a direction generally parallel to the axis of the pistol bore and opens through the rear of the headspace extension hood 30. In FIG. 3 the pistol bore axis is indicated by the letter A. The notch 15 has a crescent shaped inner end wall 46 which, as shown, is preferably semi-cylindrical and generally tangent to the plane of the breechface 28. The rear portion of the notch is preferably formed by a pair of opposing sidewalls 50, 50 which extend rearwardly in parallel relation to each other and to the pistol bore axis A from opposite ends of the semi-circular inner end wall 46. A chamfer 52 is preferably formed at the upper end of the notch 15, substantially as shown.

The chamber status indicator hereinbefore described allows the user of a pistol to see a portion of the rim of a cartridge, such as the cartridge C shown in FIG. 6, when the cartridge is chambered in the pistol and viewed from above and through the notch 12. When the pistol is loaded the rim of the chambered cartridge case, which has a brass or sliver color, can be seen when viewed through the notch 15. In contrast, the empty chamber 26 appears dark when the firearm is not loaded.

The dimensions and precise configuration of the notch 15 may vary and depend upon the size of the headspace extension hood. The dimensions of the aperture 15 are not critical, but an aperture or slot adequate to allow for visual observation of the rim of a chambered cartridge is necessary. The production cost added by the provision of the present chamber status indicator is minimal, because the provision of the indicator does not add parts to the firearm. The headspace extension hood does not function to provide support for a chambered cartridge, therefore no loss of barrel strength or integrity results from modification of the headspace extension hood.

Further, and in accordance with the present invention, a firearm of the general type hereinbefore described and having a headspace extension hood, which is externally exposed in the closed breech position of the firearm, may be readily retrofitted with a chamber status indicator such as hereinbefore described. The retrofitting method includes the steps of removing the barrel from the firearm to be retrofitted and forming an aperture or notch 15 in the headspace extension hood 30 generally as hereinbefore discussed. A notch is preferably formed in and centrally of the rear edge of the headspace hood extension by a milling operation. The notch forming operation is terminated when the forward-most end of the notch is disposed in alignment with the plane of the breechface. The lateral width of the milled notch or slot is preferably approximately equal to 35 percent of the lateral width of the headspace extension hood. If the head-space hood extension on the firearm to be retrofitted is sufficiently large the aperture 12 may comprise a cylindrical hole formed by drilling a cylindrical hole through the headspace extension hood and tangent to the breechface. The retrofitting operation is completed by forming a chamfer at the upper or exposed outer end of the aperture 12.

Figure 7:
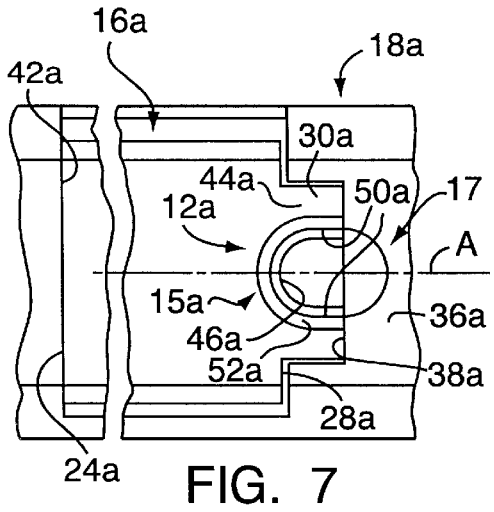
FIG. 7 is similar to FIG. 3 but shows a further embodiment of the invention.
Figure 8:
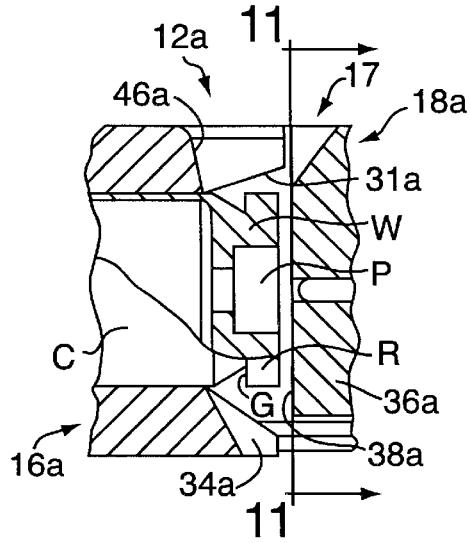
FIG. 8 is a fragmentary axial sectional view through the barrel and the slide of FIG. 7 and shows the breech in closed position and a round of ammunition in the chamber.
Figure 9:
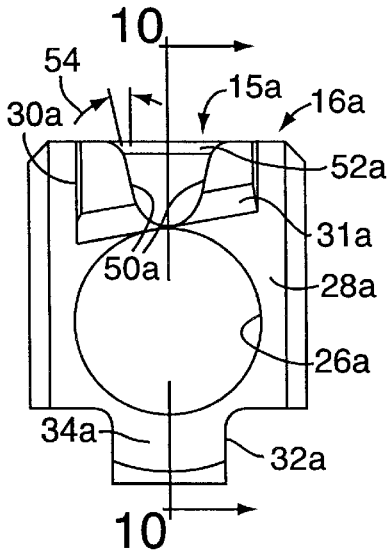
FIG. 9 is a somewhat enlarged rear elevational view of the barrel shown in FIGS. 7 and 8.
Figure 10:
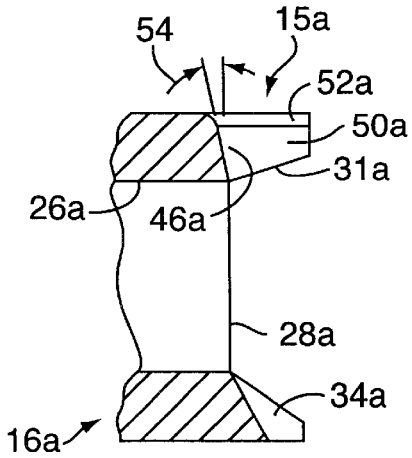
FIG. 10 is a sectional view taken along the line 10—10 of FIG. 9.

Referring again to the drawings and considering now FIGS. 7 through 11, another chamber status indicator embodying the present invention is illustrated and described with reference to a modified semi-automatic pistol identical in most respects to pistol 10 hereinbefore described, but differing from the pistol 10 only in the construction and arrangement of the chamber status indicator thereof. In FIGS. 7 and 8 portions of the pistol barrel and slide, which form components of the modified pistol, are indicated at 16*a* and 18*a,* respectively, the chamber status indicator thereof being shown at 12*a*. The barrel 16*a* and the slide 18*a* appear in FIGS. 7 and 8 locked in closed breech or firing position. Portions of the barrel 16*a* and the slide 18*a* which correspond to portions of the barrel 16 and slide 18 of the previously described pistol 10 bear the same reference numerals as in the previously described pistol 10 but include a letter "a" suffix and may not be hereinafter further described in detail.

As in the previously described embodiment 10, the barrel 16*a* has a rearwardly facing breechface 28*a* and a headspace extension hood 30*a* which comprises an integral part of the barrel 16*a* and which projects rearwardly from the breech-face 28*a* above the cartridge chamber 26*a*. The illustrated chamber status indicator 12*a* includes a rearwardly open first notch 15*a* formed centrally within the headspace extension hood 30*a* and extending in a direction parallel to the direction of extent of the pistol bore axis, the latter axis being shown in FIG. 7 and indicated by the letter A. The chamber status indicator 12*a* further includes a second notch or groove indicated generally by the numeral 17 and formed in the slide 18*a*. The second notch opens forwardly through the boltface 38*a* and upwardly through the slide in 18*a* in registry with the first notch 15*a* when the slide is in its closed breech or firing position, as it appears in FIG. 7. The second notch 17 cooperates with the first notch 15*a* to provide indication of chamber status by direct visual observation when the slide is in its firing position, as will be hereinafter further discussed.

It should be understood that the present invention may be practiced with a first notch 15*a* which may be substantially identical to the previously described notch 15 and which includes a parti-cylindrical inner end wall 46, terminated at and tangent to the breechface 28*a,* and opposing parallel sidewalls 50, 50 which form junctions with and extend rearwardly from opposite ends of the semi-cylindrical inner end wall 46 in parallel relation to each other and to the bore axis A as previously illustrated and described. However, the presently preferred first notch 15*a* is preferably defined by an upwardly and forwardly flared inner end wall and a pair of opposing upwardly and outwardly flared sidewalls. More specifically, the first notch 15*a* is preferably defined by a parti-conical inner end wall 46*a,* which opens rearwardly through and diverges forwardly and upwardly from the breechface 28*a* and upwardly and laterally outwardly at the breechface and above the chamber 26*a,* and a pair of opposing sidewalls 50*a,* 50*a* which form junctions at the breechface 28*a* with the upwardly and laterally outwardly diverging rear ends of the parti-conical first notch inner end wall 46*a*. The first notch inner end wall 46*a* and the sidewalls 50*a,* 50*a* form draft angles of approximately 12 degrees to the vertical as oriented in FIGS. 9 and 10 where the draft angles of the notch walls are indicated by the numeral 54. The upper end of the notch 15*a* is chamfered, a radial chamfer being presently preferred and indicated at 52*a*.

Figure 11:
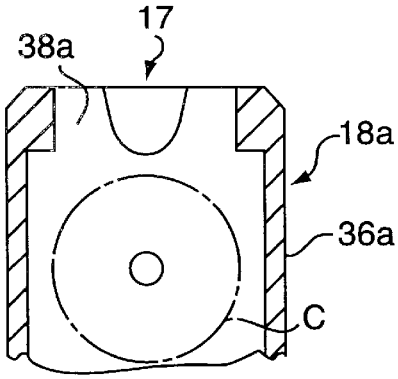
FIG. 11 is a fragmentary sectional view taken along the line 11—11 of FIG. 8, the position of a cartridge base relative to the bolt face in closed breech condition being indicated by broken lines.

The second notch 17, which cooperates with the first notch 15*a* to form the chamber status indicator 12*a,* preferably comprises an upwardly diverging parti-conical groove formed in the bolt portion of the slide and opening forwardly through the bolt face 38*a* and upwardly through the upper surface of the slide 18*a* at a level above the level of the chamber 26*a*. The second notch 17 is in general registry with the first notch 15*a* when the slide 18*a* and barrel 16*a* are locked in the closed breech or firing position, as shown in FIGS. 7 and 8. The upper edge of the notch 17 may be chamfered, if desired. FIG. 11 is a vertical sectional view through the slide 18*a* taken at the bolt face. A footprint of a cartridge C is indicated on the bolt face 38*a* by broken lines and shows that the notch 17 is located above the base of a chambered cartridge when the breech is locked in closed position.

Further referring to FIG. 8 a typical chambered cartridge C is shown with a portion of the case broken away to reveal structure therebehind. The cartridge case comprises a generally cylindrical shell which has a relatively thin sidewall S and a substantially thicker generally radially disposed web W which carries a primer P and cooperates with the sidewall S to define a cup containing explosive material. The web defines a rim R and an annular extractor groove G forward of the rim. When the cartridge C is properly chambered, as generally shown in FIG. 8, the rim R and the extractor groove G are disposed within the headspace, formed between the breechface 28*a* and the bolt face 38*a,* and a portion of the web forward of the extractor groove G is disposed generally within the chamber 26*a*. It will now be noted that a forward end portion of the first notch 15*a,* that is the portion of the first notch located forward of the breechface 28*a,* is disposed above that portion of the web W located within the chamber 26*a*. More specifically, and in accordance with presently preferred practice, the forward end portion of the first notch is wholly located within a region of the barrel immediately vertically above the portion of the web located within the chamber when the firearm is oriented in a generally axially horizontal position.

A semi-automatic breech locking pistol modified to incorporate a chamber status indicator 12*a* in accordance with the present invention operates in a wholly conventional manner. When the pistol is fired pressure is substantially instantaneously generated at the breech by gases of explosion and peaks before the bullet leaves the barrel. This pressure acts in radial outward directions upon the inner surface of the cartridge sidewall S and in an axially rearward direction upon the forwardly facing surface of the cup, that is the forwardly facing surface defined by the web W, and provides recoil to urge the slide 18*a* toward and to its retracted position and thereby operate the action. The axially directed pressure acting upon the web W causes the cartridge case to move from the cartridge chamber 26*a* and in an axially rearward direction to take up cartridge headspace, the space between the base of the cartridge and the bolt face, and to urge the cartridge into driving engagement with the bolt face to initiate rearward movement of the slide 18*a*. The breech remains in locked condition during initial rearward movement of the slide toward retracted position and thereby provides a time delay during which the bullet leaves the barrel and pressure at the breech drops to a level at which the breech may safely open in response to further rearward movement of the slide to allow cartridge extraction to begin. As previously noted the notch 15*a* formed in the headspace extension hood 30*a* does not open into or otherwise violate the integrity of the cartridge chamber 26*a*. Consequently, the cartridge case sidewall S is wholly supported by the wall of the cartridge chamber 26*a* throughout the critical period during which the breech remains in locked condition and pressure within the breech attains a maximum level.

It will also be apparent from further reference to FIG. 8, where the footprint of the cartridge base is shown on the bolt face, that the second notch 17 opens through the bolt face above the level of the base of a cartridge and does not violate the region of the bolt face which is engaged by the base of the cartridge. Thus, the bolt face provides support for the entire base area of a cartridge C throughout the critical period while the breech is in its locked condition and the cartridge case is subjected to maximum pressure generated at the breech by the gases of explosion. It should now be apparent that provision of a chamber status indicator 12*a* on a pistol and in accordance with the present invention does not alter the operational characteristics of the pistol or otherwise interfere with its normal firing cycle.

The upwardly and outwardly flared walls of the chamber status indicator 12*a* substantially improve the light gathering characteristics of the device and optimizes the ability of a shooter using the device to physically see whether a cartridge is present in the cartridge chamber. The provision of an additional upwardly and outwardly flared notch or groove in the bolt-defining portion of a pistol slide to cooperate with an aperture formed in a headspace extension hood allows entry of additional light into the resulting chamber observation port and substantially improves the viewing angle so that a shooter may visually observe the condition of the cartridge chamber by looking over the top of the pistol while the pistol is safely pointed downrange, making it unnecessary to substantially tilt or otherwise point the pistol in what may be an unsafe direction while visually determining chamber status.

While the present invention has been illustrated and described with reference to a pistol, it should be understood that the concepts illustrated and herinbefore described may be employed in firearms of other types and such applications are contemplated within the scope of the present invention.

We claim:

1. A semi-automatic pistol comprising a frame, a slide having a forwardly facing bolt face and an upwardly and laterally outwardly open ejection port and supported on said frame for forward and rearward reciprocal movement between firing and retracted positions relative to said frame, an axially elongated barrel supported on said frame and at least partial disposed within said slide, said barrel having a rearwardly facing breechface, a bore extending axially therethrough, a chamber at the rear of said bore and opening through said breechface, and a headspace extension hood rearwardly projecting from said breechface above said chamber, said breechface and said bolt face defining headspace therebetween, said headspace extension hood overlying said headspace when said slide is in said firing position, and chamber status indicating means for enabling determination as to whether a round of ammunition is chambered within said pistol and including a rearwardly open first notch extending through said headspace hood extension and exposed within said ejection port when said slide is in said firing position, and a second notch formed in said slide and opening forwardly through said bolt face and upwardly through said slide in registry with said first notch wherein said slide is in said firing position, said second notch cooperating with said first notch to provide indication of chamber status by direct visual observation when said slide is in said firing position.

2. A semi-automatic pistol as set forth in claim 1 wherein said second notch is defined by a parti-conical surface.

3. A semi-automatic pistol as set forth in claim 2 wherein said parti-conical surface diverges upwardly and rearwardly away from said bolt face.

4. A semi-automatic pistol as set forth in claim 2 wherein said first notch terminates at a forward end at said breechface.

5. A semi-automatic pistol as set forth in claim 4 wherein said first notch has a crescent shaped inner end portion.

6. A semi-automatic pistol as set forth in claim 5 wherein said crescent shaped inner end portion is generally semi-cylindrical.

7. A semi-automatic pistol as set forth in claim 6 wherein said semi-cylindrical inner end portion is generally tangent to a plane defining said breechface.

8. A semi-automatic pistol as set forth in claim 7 wherein said first notch has a rear portion defined by a pair of opposing rearwardly extending surfaces diverging upwardly and away from each other.

9. A semi-automatic pistol as set forth in claim 2 wherein said first notch opens upwardly through said headspace extension hood and has a chamfer at its upper end.

10. A semi-automatic pistol as set forth in claim 2 wherein said headspace extension hood has an upwardly inclined and laterally outwardly extending lower surface.

11. A semi-automatic pistol as set forth in claim 10 wherein said lower surface is upwardly and rearwardly inclined from said breechface.

12. A semi-automatic pistol as set forth in claim 2 wherein said first notch has an upwardly open forward end portion formed in said barrel forward of said breechface and opening rearwardly through said breechface above said chamber.

13. A semi-automatic pistol as set forth in claim 12 wherein said forward end portion is defined by a parti-conical upwardly diverging surface.

14. A semi-automatic pistol as set forth in claim 13 wherein said first notch has a rear end portion defined by a pair of opposing laterally spaced apart and upwardly diverging side surface forming rearward extensions of said parti-conical surface.

15. A semi-automatic pistol comprising a frame, a slide supported on said frame for rearward and forward reciprocal sliding movement between firing and retracted positions and having a forward part defining a downwardly open recess and a rear part including a bolt having a forwardly facing bolt face, said slide having an upwardly and laterally outwardly open ejection port opening into said recess and partially defined by an upward extension of said bolt face, an axially elongated barrel loosely supported by said frame and at least partially disposed within said recess, said barrel having a generally rearwardly facing breechface and an axially extending bore including a chamber opening axial through said breechface, said barrel having an integral headspace extension hood rearwardly projecting from said breechface immediately above said chamber, and chamber status indicating means for determining whether a round of ammunition is chambered in said pistol and including a rearwardly open first notch formed centrally within said headspace extension hood and extending in a direction parallel to the direction of extent of the bore axis, said first notch opening upwardly through said headspace extension hood and having a parti-conical forward end portion and a pair of opposing laterally spaced apart side walls extending rearwardly in parallel relation to the axis of said bore and upwardly and laterally outwardly diverging away from each other, said chamber status indicating means further including a second notch formed in said bolt and opening upwardly through said bolt and forwardly through said bolt face, said second notch being defined by an upwardly diverging parti-conical surface, said second notch being in registry with said first notch when said slide is in its firing position.

16. The semi-automatic pistol as set forth in claim 15 wherein said headspace extension hood has an upwardly and laterally outwardly inclined lower surface inclined upwardly and rearwardly away from said breechface.

17. In a firearm in combination with a cartridge, said firearm including a barrel defining a rearwardly facing breech face and a bore extending axially therethrough and defining a chamber opening through the breech face for receiving and containing at least a portion of said cartridge having a case including a generally coaxial tubular sidewall and a generally radially disposed web defining a base, the web being at least partially disposed within the chamber, and a bolt movable relative to the barrel between open and closed breech positions, the bolt having a bolt face disposed in close proximity to the base and the breech face when the bolt is in its closed breech position, the improvement comprising:

a chamber status indicator for determining whether said cartridge is disposed within said chamber and including an upwardly open first notch formed in said barrel and having a forward end portion located forward of said breech face and wholly within a region of said barrel immediately vertically above said portion of said web of said cartridge disposed within said chamber when said firearm is in an axially horizontally oriented position, said first notch opening through said breech face above said chamber; and an upwardly open second notch formed in said bolt and opening forwardly through said bolt face at a level above the base of said cartridge received in said chamber and in registry with said first notch when said bolt is in said closed breech position.

18. In a firearm as set forth in claim 17 the further improvement wherein said forward end portion is generally forwardly and upwardly inclined from said breech face.

19. In a firearm as set forth in claim 18 the further improvement wherein said first notch has opposing upwardly and laterally outwardly flared sidewalls.

20. In a firearm as set forth in claim 19 wherein each of said sidewalls is inclined upwardly and laterally outwardly at an angle of approximately twelve degrees to the vertical.

21. In a firearm as set forth in claim 20 wherein said first notch has a chamfer at the upper end thereof.

* * * * *